US007481383B2

(12) United States Patent
Joseph

(10) Patent No.: US 7,481,383 B2
(45) Date of Patent: Jan. 27, 2009

(54) FUEL INJECTOR INCLUDING A COMPOUND ANGLE ORIFICE DISC FOR ADJUSTING SPRAY TARGETING

(75) Inventor: J. Michael Joseph, Newport News, VA (US)

(73) Assignee: Continental Automotive Systems US, Inc., Auburn Hills, MI (US)

( * ) Notice: Subject to any disclaimer, the term of this patent is extended or adjusted under 35 U.S.C. 154(b) by 63 days.

(21) Appl. No.: 11/649,517

(22) Filed: Jan. 4, 2007

(65) Prior Publication Data

US 2007/0125889 A1 Jun. 7, 2007

Related U.S. Application Data

(63) Continuation of application No. 10/835,617, filed on Apr. 30, 2004, now Pat. No. 7,201,329.

(51) Int. Cl.
*F02M 51/00* (2006.01)

(52) U.S. Cl. ..... 239/585.5; 239/494; 239/497; 239/552; 239/533.12; 239/585.1; 239/596

(58) Field of Classification Search ..... 239/491, 239/494, 497, 552, 533.12, 584, 585.1, 596, 239/585.4, 585.5; 29/890.132, 890.142, 29/890.143

See application file for complete search history.

(56) References Cited

U.S. PATENT DOCUMENTS

| | | | | | |
|---|---|---|---|---|---|
| 4,621,772 | A * | 11/1986 | Blythe et al. | ..... | 239/585.4 |
| 4,854,024 | A * | 8/1989 | Grieb et al. | ..... | 29/890.132 |
| 5,484,108 | A * | 1/1996 | Nally | ..... | 239/585.4 |
| 5,489,065 | A * | 2/1996 | Nally, Jr. | ..... | 239/552 |
| 5,746,376 | A * | 5/1998 | Romann et al. | ..... | 239/585.4 |
| 5,862,991 | A * | 1/1999 | Willke et al. | ..... | 239/585.4 |
| 6,070,812 | A * | 6/2000 | Tani et al. | ..... | 239/552 |
| 6,089,476 | A * | 7/2000 | Sugimoto et al. | ..... | 239/596 |
| 6,966,499 | B2 * | 11/2005 | Nally et al. | ..... | 239/596 |

* cited by examiner

*Primary Examiner*—Steven J Ganey

(57) ABSTRACT

A fuel injector includes an orifice disc. The orifice disc includes a peripheral portion, a central portion, and an orifice. The peripheral portion is with respect to a longitudinal axis and extends parallel to a base plane. The peripheral portion bounds the central portion. The central portion includes a facet that extends parallel to a plane that is oblique with respect to the base plane. The orifice penetrates the facet and extends along an orifice axis that is oblique with resect to the plane. As such, the orientation of the orifice with respect to the longitudinal axis is defined by a combination of (1) a first relationship of the plane with respect to the base plane, and (2) a second relationship of the orifice axis with respect to the plane. A method of forming a multi-facetted dimple for the orifice disc is also described.

5 Claims, 6 Drawing Sheets

FIG. 1 A
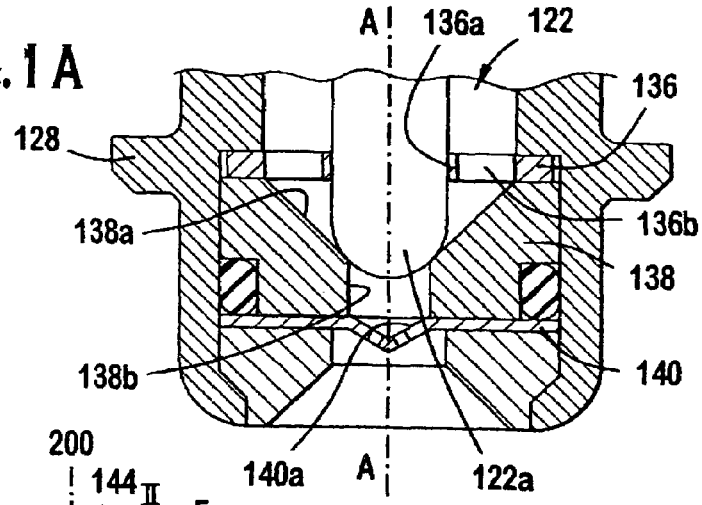
FIG. 1 B
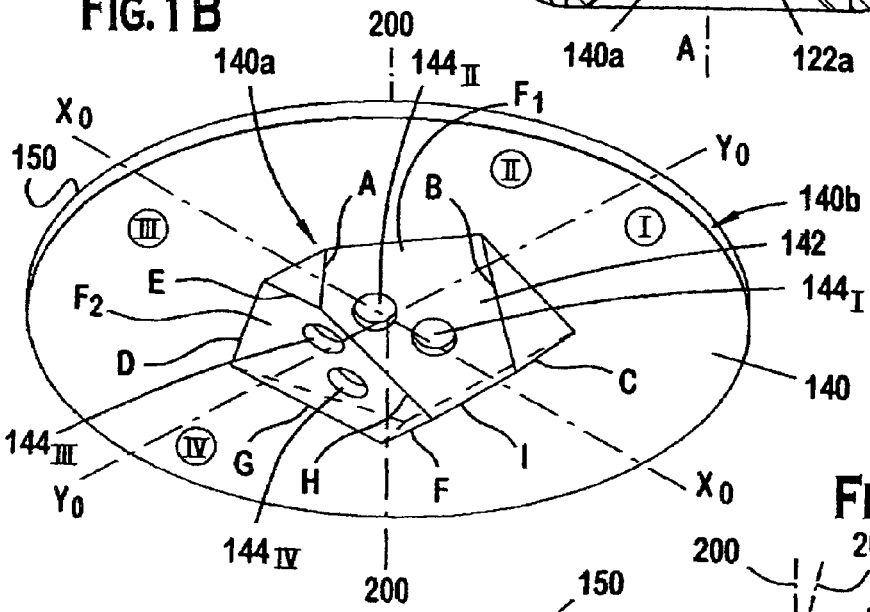
FIG. 2
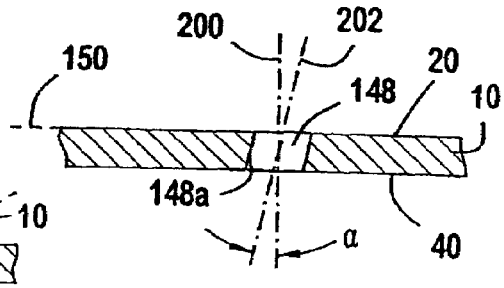
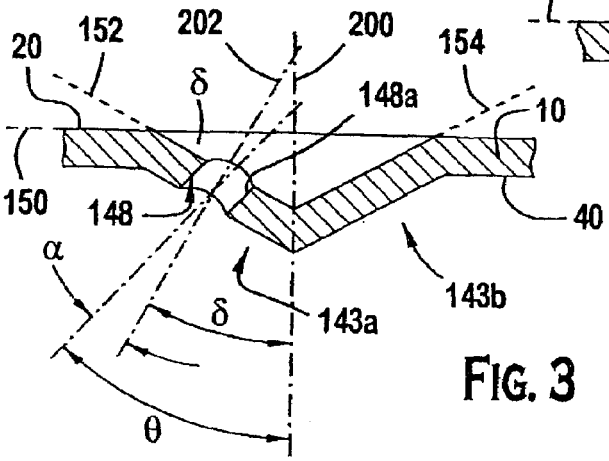
FIG. 3

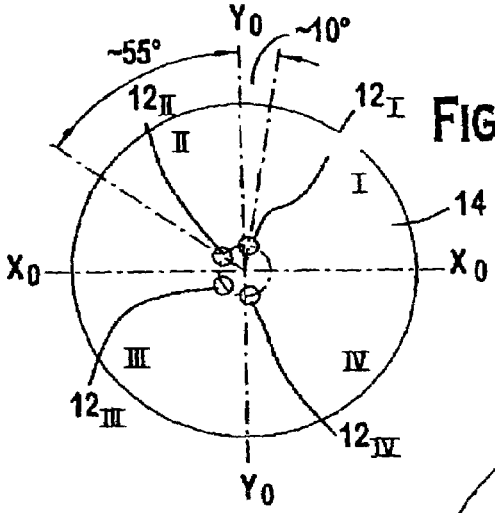
FIG. 4A
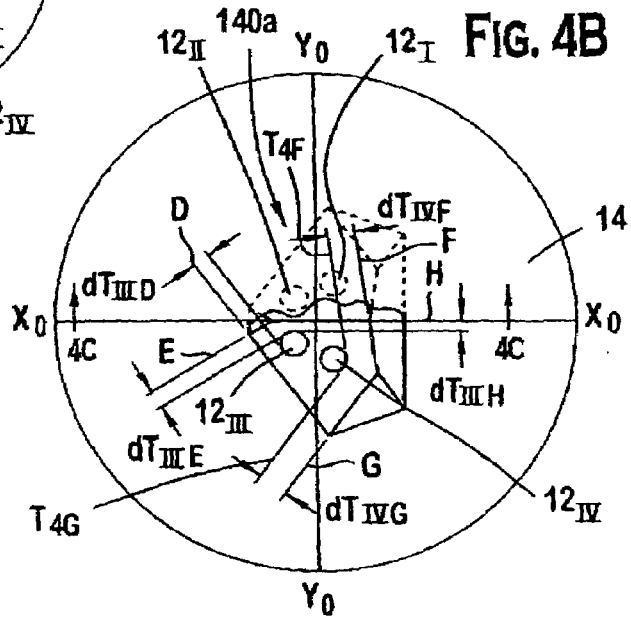
FIG. 4B
FIG. 4C
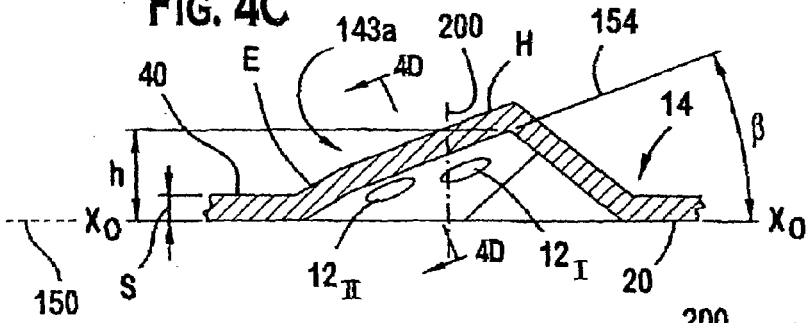
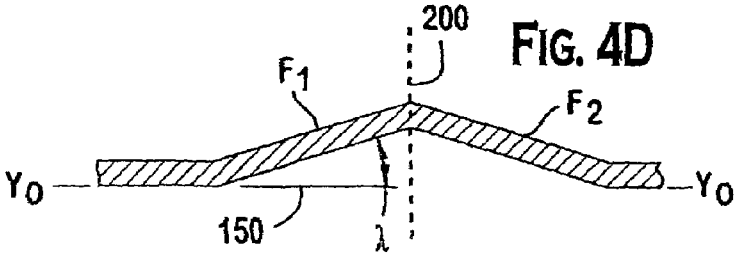
FIG. 4D

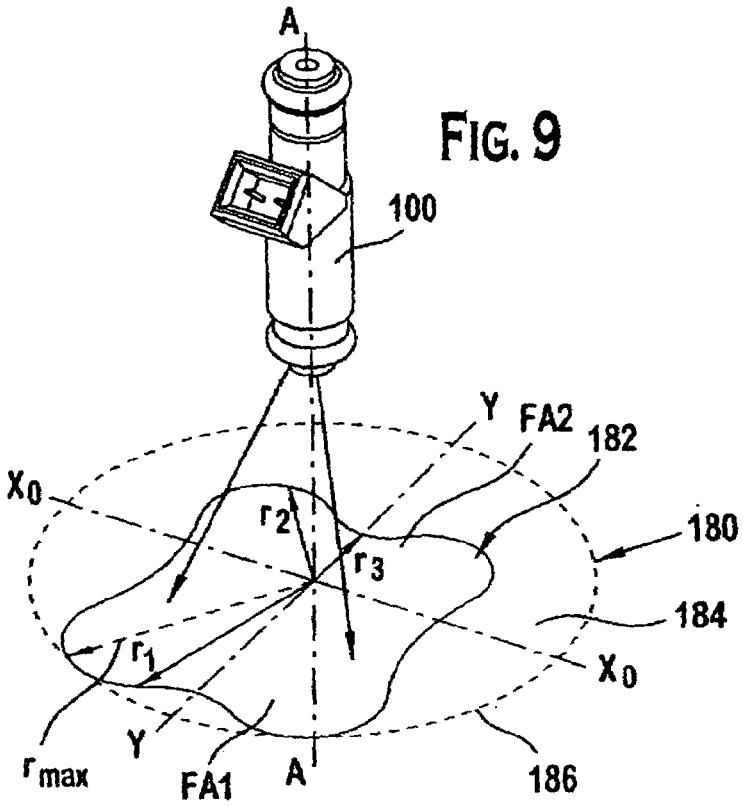
FIG. 9
FIG. 10
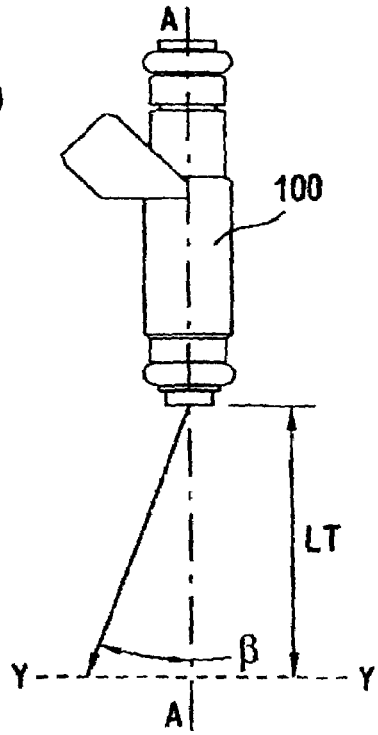
FIG. 11
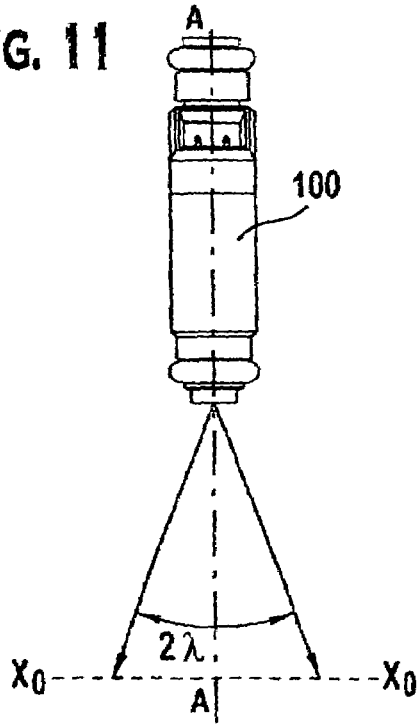

FUEL INJECTOR INCLUDING A COMPOUND ANGLE ORIFICE DISC FOR ADJUSTING SPRAY TARGETING

This nonprovisional application is a continuation and claims the benefit of U.S. application Ser. No. 10/835,617, filed Apr. 30, 2004 now U.S. Pat. No. 7,201,329.

FIELD OF THE INVENTION

This invention relates generally to electrically operated fuel injectors of the type that inject volatile liquid fuel into an automotive vehicle internal combustion engine, and in particular the invention relates to a novel thin disc orifice member for such a fuel injector.

BACKGROUND OF THE INVENTION

It is believed that contemporary fuel injectors must be designed to accommodate a particular engine. The ability to meet stringent tailpipe emission standards for mass-produced automotive vehicles is at least in part attributable to the ability to assure consistency in both shaping and aiming the injection spray or stream, e.g., toward intake valve(s) or into a combustion cylinder. Wall wetting should be avoided.

Because of the large number of different engine models that use multi-point fuel injectors, a large number of unique injectors are needed to provide the desired shaping and aiming of the injection spray or stream for each cylinder of an engine. To accommodate these demands, fuel injectors have heretofore been designed to produce straight streams, bending streams, split streams, and split/bent streams. In fuel injectors utilizing thin disc orifice members, such injection patterns can be created solely by the specific design of the thin disc orifice member. This capability offers the opportunity for meaningful manufacturing economies since other components of the fuel injector are not necessarily required to have a unique design for a particular application, i.e. many other components can be of common design.

Another concern in contemporary fuel injector design is minimizing a volume downstream of a needle/seat sealing perimeter and upstream of the orifice hole(s). As it is used in this disclosure, this volume is known as the "sac" volume. This sac volume is related to the maximum depth or height of a dimpled surface extending from the orifice disc. As a practical matter, the practical limit of dimpling a geometric shape into an orifice disc preconditioned with straight orifice holes is the maximum depth or height required to obtain the desired spray angle(s). As the depth of the geometry is increased in order to obtain the large bending and splitting spray angles, the amount of individual hole and dimple distortion also increases and the sac volume may increase to a volume larger than is desired Notwithstanding the potential increase in sac volume when the orifice disc is dimpled in order to obtain large values of bending and splitting spray angles, the disc material, in extreme cases, may shear between holes or at creases in the geometrical dimple, thereby rendering the orifice disc unsuitable to function as desired, such as, for example, metering fuel flow.

It is believed that a known orifice disc can be formed in the following manner. A flat orifice disc is initially formed with an orifice that extends generally perpendicular to the flat orifice disc, i.e., a "perpendicular" orifice. In order to achieve a bending or splitting angle, i.e., an angle at which the orifice is oriented relative to a longitudinal axis of the fuel injector, the region about the orifice is dimpled—such that the flat orifice disc is no longer generally planar in its entirety but is now provided with a multi-facetted dimple. As the orifice disc is dimpled, the material of the orifice disc is forced to yield plastically to form the multi-facetted dimple. The multi-facetted dimple includes at least two sides extending at a dimpling angle, i.e., the angle at which the planar surface of the facet on which the orifice is disposed thereon is oriented relative to the originally flat surface towards an apex. Since the orifice is located on one of the sides, the orifice is also oriented at a bending angle $\beta$. Because the orifice originally extends perpendicularly through the flat surface of the disc, i.e., a "base" plane, a bending angle of the orifice, subsequent to the dimpling, generally approximates the dimpling angle. And depending on the physical properties of the material such as, for example, thickness and yield strength of the material, it is believed that there is an upper limit to the dimpling angle, as too great a dimpling angle can cause the material to shear, rendering the orifice disc structurally unsuitable for its intended purpose.

SUMMARY OF THE INVENTION

The present invention provides for an orifice disc with orifices oriented at an angle that is no longer exclusively related to a dimpling angle but is related to both an oblique angle at which the orifice is oriented relative to a base plane of the orifice disc and the dimpling angle. Thus, the present invention provides for a novel form of thin disc orifice members that can enhance the ability to meet different and/or more stringent demands with equivalent or even improved consistency. For example, certain thin disc orifice members according to the invention are well suited for engines in which a single fuel injector is required to direct sprays or stream to one or more intake valve; and thin disc orifice members according to the invention can satisfy difficult installations where space for mounting the fuel injector is severely restricted due to packaging constraints. It is believed that one of the advantages of the invention arises because the metering orifices are located in facetted planar surfaces. This has been found important in providing enhanced flow stability for proper interaction with upstream flow geometries internal to the fuel injector. The presence of a metering orifice in a non-planar surface, such as in a conical dimple, may not be able to consistently achieve the degree of enhanced flow stability that is achieved by its disposition on a facetted planar surface as in the present invention. The particular shape for the indentation that contains the facetted planar surfaces having the metering orifices further characterizes the present invention.

The preferred embodiments of the present invention allow for a desired targeting of fuel spray. The desired targeting of fuel spray is one which is similar to a fuel spray targeting generated by a control case. By virtue of the preferred embodiments, however, a desired spray targeting similar to the spray targeting of the control case can be obtained while providing for a fuel injector that has less sac volume and less material deformation in an orifice disc than that of the control case. Consequently, it is believed that the present invention provides a better control of fuel flow and spray angles by virtue of reduced orifice hole distortion, and reduced likelihood of orifice disc material shearing.

The present invention provides a fuel injector for spray targeting fuel. The fuel injector includes a seat, a movable member, and an orifice disc. The seat includes a passage that extends along a longitudinal axis. The movable member cooperates with the seat to permit and prevent a flow of fuel through the passage. The orifice disc includes first and second surfaces, a peripheral portion, a central portion, and a first orifice. The first surface confronts the seat, and the second surface faces opposite the first surface. The peripheral portion extends parallel to a base plane, and the base plane being disposed generally orthogonal with respect to the longitudinal axis. The central portion being bounded by the peripheral portion and includes first and second planar facets extending from the peripheral portion. The first and second planar facet intersect each other to define a segment extending at a first angle of less then 21 degrees with respect to the base plane. Each of the first and second planar facets extends at a second angle of less than 16 degrees with respect to the base plane. At least one orifice penetrates each of the first and second planar facets and being defined by a first wall coupling the first and second surfaces. The at least one orifice extends along a first orifice axis, and the first orifice axis is oriented with respect to the longitudinal axis by a combination of a first relationship of the planar facet surface with respect to the base plane and a second relationship of the first orifice axis with respect to the planar facet surface so that when the magnetic actuator moves the closure member to the actuated position, a flow of fuel from the orifice disc intersects a virtual plane orthogonal to the longitudinal axis to define a flow pattern having a first portion about a first arcuate sector of about 180 degrees being greater in area than a second portion on a contiguous second sector of about 180 degrees on the virtual plane.

The present invention further provides a method of targeting fuel flow through at least one metering orifice of a fuel injector to a target area contiguous to a virtual plane disposed generally orthogonal to a longitudinal axis extending through the fuel injector. The fuel injector has a passageway extending between an inlet and outlet along the longitudinal axis. The fuel injector includes a seat proximate the outlet, an orifice disc having a perimeter generally perpendicular to the longitudinal axis, and a closure member disposed in the passageway and coupled to a magnetic actuator. When the magnetic actuator is energized, the actuator positions the closure member so as to allow fuel flow through the passageway and past the closure member through the seat aperture. The orifice disc includes first and second surfaces that extend substantially parallel to a base plane and that are spaced along a longitudinal axis extending orthogonal with respect to the base plane. The method can be achieved by locating a plurality of metering orifices oriented at an oblique angle with respect to the longitudinal axis; forming first and second planar surfaces on which the metering orifices are disposed on, the first and second planar surfaces extending from a base portion of the orifice disc at a first angle with respect to the base portion and intersecting each other to form an edge oriented at a bending spray angle with respect to the base portion; flowing fuel through the metering orifices upon actuation of the fuel injector so that a fuel flow path intersecting the virtual plane defines a flow pattern having a plurality of different radii about the longitudinal axis, one of the radii including a maximum radius that, when rotated about the longitudinal axis, defines a circular area larger than the flow area, and orientating the flow pattern about the longitudinal axis so as to adjust a targeting of the flow pattern towards a different portion of the circular area.

BRIEF DESCRIPTION OF THE DRAWINGS

The accompanying drawings, which are incorporated herein and constitute part of this specification, illustrate presently preferred embodiments of the invention, and, together with the general description given above and the detailed description given below, serve to explain features of the invention.

FIG. 1A is a cross-sectional view of the outlet end portion of the fuel injector of FIG. 1.

FIG. 1B is a perspective view of a multi-faceted dimpled orifice disc according to a preferred embodiment.

FIG. 2 is fragmentary cross-sectional view of an orifice disc according to a preferred embodiment of the present invention in an intermediate condition.

FIG. 3 is a fragmentary cross-sectional view of the orifice disc according to the preferred embodiment of the present invention, as shown in FIG. 1B, in a final condition.

FIGS. 4A and 4B illustrate the dimensions of an orifice disc in an initial pre-dimpled configuration to a final dimpled configuration for a control case of a comparative analysis that achieves a predetermined spray targeting.

FIGS. 4C and 4D illustrate other dimensions of the thin disc of FIG. 4B.

FIG. 9 illustrates an isometric view of the fuel injector with generally similar spray targeting and flow pattern as the control case.

FIG. 10 illustrates the bending spray angle of the fuel flow of FIG. 9.

FIG. 11 illustrates the splitting spray angle of the fuel flow of FIG. 9.

DETAILED DESCRIPTION OF THE PREFERRED EMBODIMENT(S)

Figure 1:
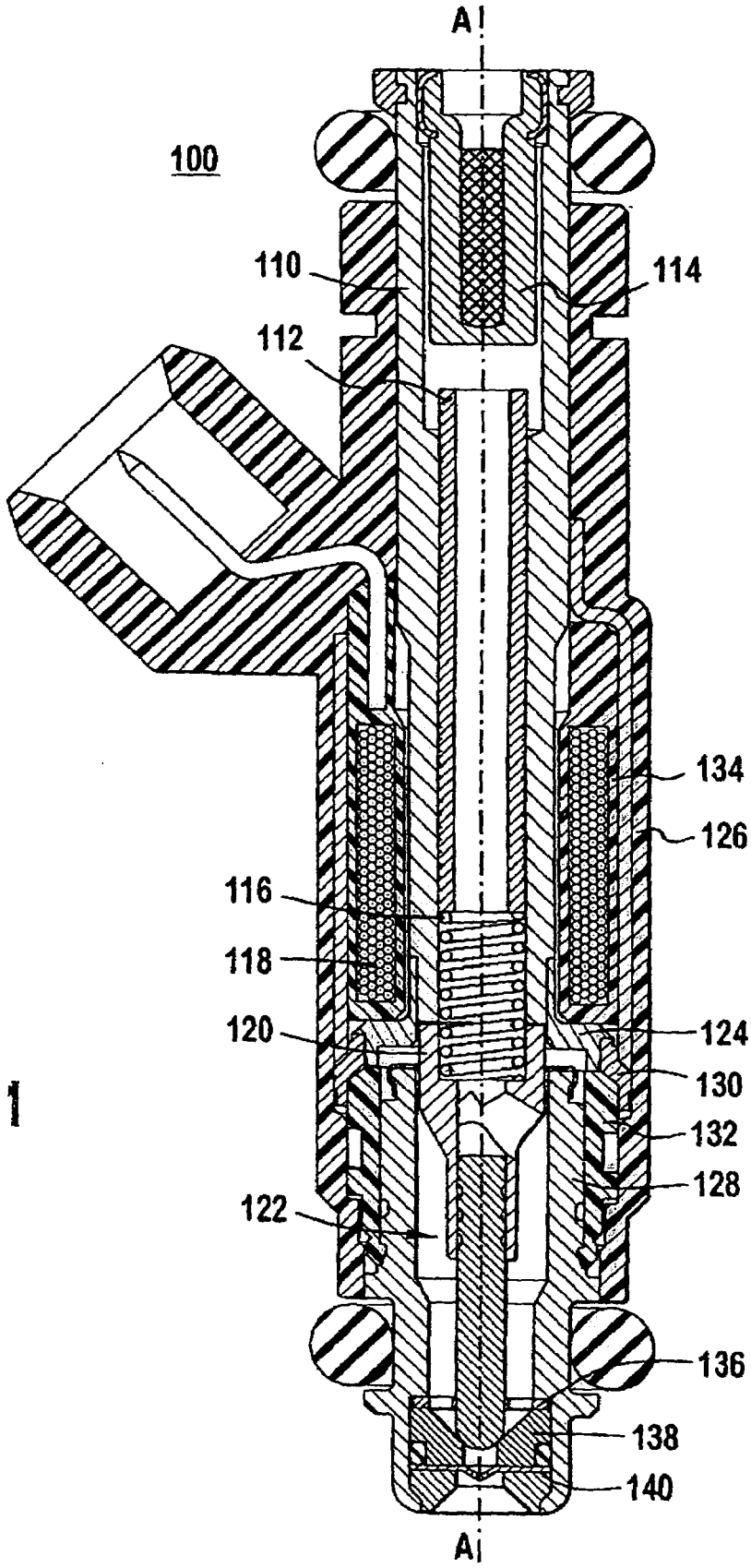
FIG. 1 is a cross-sectional view of a fuel injector according to a preferred embodiment of the present invention.

FIGS. 1-3 and 5-11 illustrate the preferred embodiments. In particular, a fuel injector 100 includes: a fuel inlet tube 110, an adjustment tube 112, a filter assembly 114, a coil assembly 118, a coil spring 116, an armature 120, a closure member assembly 122, a non-magnetic shell 124, a fuel injector overmold 126, a body 128, a body shell 130, a shell overmold 132, a coil overmold 134, a guide member 136 for the closure member assembly 122, a seat 138, and an orifice disc 140. The construction of fuel injector 100 can be of a type similar to those disclosed in commonly assigned U.S. Pat. Nos. 4,854,024; 5,174,505; and 6,520,421, which are incorporated by reference herein in their entireties.

FIG. 1A shows the outlet end of a body 128 of a solenoid operated fuel injector 100 having an orifice disc 140 according to a preferred embodiment. The outlet end of fuel injector 100 includes a guide member 136 and a seat 138, which are disposed axially interiorly of orifice disc 140. The guide member 136, seat 138 and disc 140 can be retained by a suitable technique such as, for example, forming a retaining lip with a retainer or by welding the disc 140 to the seat 138 and welding the seat 138 to the body 128.

Seat 138 can include a frustoconical seating surface 138*a* that leads from guide member 136 to a central passage 138*b* of the seat 138 that, in turn, leads to a dimpled central portion 140*a* of orifice disc 140. Guide member 136 includes a central guide opening 136*a* for guiding the axial reciprocation of a sealing end 122*a* of a closure member assembly 122 and several through-openings 136*b* distributed around opening 136*a* to provide for fuel to flow into the fuel sac volume discussed earlier. The fuel sac volume is the encased volume downstream of the needle sealing seat perimeter, which is the interface of 122*a* and 138*a*, and upstream of the metering orifices in the area 140*a*. FIG. 1A shows the hemispherical sealing end 122*a* of closure member assembly 122 seated on sealing surface 138*a*, thus preventing fuel flow through the fuel injector.

As shown in FIG. 1A, a volume is defined by the first surface of the orifice disc and the sealing end 122*a* cooperating with the seat 138 to prevent the flow of fuel. This volume is generally related to the orientation of the first orifice with respect to the longitudinal axis. That is, with reference to FIGS. 2 and 3, as the first orifice 148 is oriented at increasing angle δ relative to axis 200, this volume, also known as the "sac" volume, increases. Conversely, as the first orifice 148 is oriented at decreasing angle δ relative to the axis 200, the sac volume decreases.

The orifice disc 140, as viewed from outside of the fuel injector in a perspective view of FIG. 1B, has a generally circular shape with a circular outer peripheral portion 140*b* that circumferentially bounds the central portion 140*a* that is disposed axially in the fuel injector.

With reference to FIGS. 2 and 3, the preferred embodiments achieve an increased bending angle θ that is dependent on both an orifice angle α and the dimpling angle δ instead of exclusively on the dimpling angle δ. That is, the preferred embodiments achieve an increase in the bending angle θ without an increase in a dimpling angle δ that must be applied to the work piece, thereby achieving advantages that were heretofore not available. Additional advantages can be obtained in the magnitude of the splitting angle or combination of splitting and bending angles depending on the orientation of the α angle of the orifice in FIG. 2, such as, for example, by maintaining the punch tool at the same angle relative to axis 200 (i.e., tool being contiguous to a plane orthogonal to the base plane 150) and rotating the punch tool about base plane 150 (i.e., so that the tool is on a plane oblique to the base plane 150) to affect both the bending and splitting angles.

Briefly, the increased bending angle θ can be formed by initially forming an orifice with a suitable tool that is angled to a flat work piece 10 at the orifice angle α, i.e., "angled" orifice, relative to a virtual base plane 150 which is contiguous to at least a portion of disc. That is, the wall 148*a* of the orifice 148 is oriented about orifice axis 202, which is contiguous to a plane orthogonal to the base plane 150. Thereafter, the work piece 10 is deformed in a dimpling operation, to form a multi-facetted dimple 143*a* at the same dimpling angle δ as in the conventional dimpled disc. As shown in FIG. 3, however, the new bending angle θ is not related directly as a function of the dimpling angle δ but is related as a function of two angles: (1) the orifice angle α and (2) the dimpling angle δ. Thus, the increased bending angle θ for spray targeting results from approximately the sum of the orifice angle α and the dimpling angle δ. An additional configuration of the orifice 148 in FIG. 2 can be obtained by maintaining, prior to the dimpling operation, the same conical punch tool (not shown) at the same orifice angle relative to the longitudinal axis 200 and then rotating (clocking) it about the axis 200 so that the working end of the suitable tool is no longer co-planar to the cross sectioned surface as defined in FIG. 2. This configuration is believed to provide an additional degree-of-freedom in the ability to target a fluid spray pattern by affecting both the bending angle θ and splitting angle β generally simultaneously.

In the preferred embodiments, the central portion 140*a* of orifice disc 140 includes a multi-faceted dimple 142 that is bounded by the central portion 140*a*, as shown in FIG. 1B. The central portion 140*a* of orifice disc 140 is imperforated except for the presence of one or more orifices 144 via which fuel passes through orifice disc 140. Any number of orifices 144 in a suitable array about the longitudinal axis 200 can be configured so that the orifice disc 140 can be used for its intended purpose in metering, atomizing and targeting fuel spray of a fuel injector. The preferred embodiments include four such through-orifices $\mathbf{144}_I$, $\mathbf{144}_{II}$, $\mathbf{144}_{III}$, $\mathbf{144}_{IV}$, and it can be seen in FIG. 1B, that these orifices can be disposed generally on the planar surfaces similar to a multi-faceted dimple 142 of the orifice disc 140.

Figure 6:
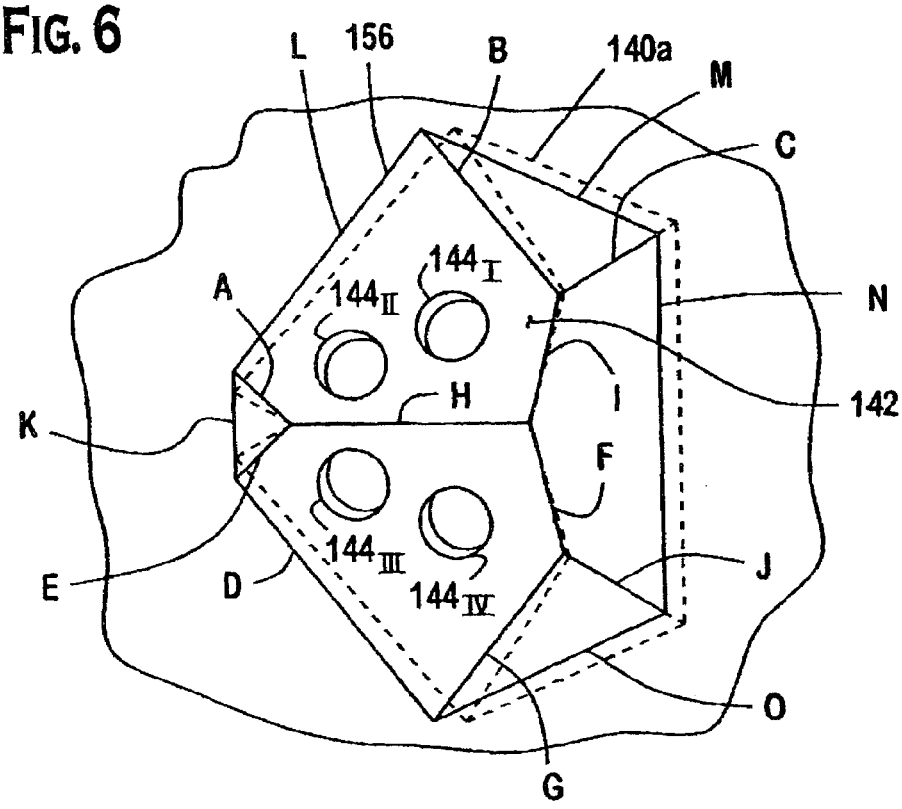
FIG. 6 illustrates a comparison between a configuration of a first preferred embodiment of an orifice disc relative to the control case that achieves the same exemplary spray results.

Referencing FIGS. 1B and 6, the multi-faceted dimple 142 of one preferred embodiment includes six generally planar surfaces oblique to a virtual base plane 150 extending between the peripheral and central portions of the orifice disc 140. The six generally planar surfaces intersect each other to form various face lie or segments denoted as A, B, C, D, E, F, G, H, I, J, K, L, M, N, and O (FIG. 6). The orifices can be located on any one of the facets as long as the facet includes sufficient area for the orifices to be disposed thereon. In the preferred embodiments, two orifices are located on a first planar facet F1 bounded by segments A, B, H, I, and L, and two other orifices are located on a second planar facet F2 bounded by segments D, E, F, G, and H. A third facet bounded by segments A, E, and K is contiguous to the first and second planar facets. A fourth facet bounded by segments J, F, C, I and N is also contiguous to the first and second planar facets. A fifth facet bounded by segments BMC and its mirror image sixth facet bounded by segments G, J, and O are contiguous to the fourth facet and to either the first or second planar facets, respectively. Although the third through sixth facets, in the preferred embodiments, are not provided with orifices penetrating through each of the third through sixth facets, these surfaces can be provided with one or more orifices in a suitable application, such as, for example, an intake port with three intake valves.

As provided by the preferred embodiments, the dimpled orifice disc 140 provides for an increase in a spray angle θ relative to a longitudinal axis A-A for each of the orifices without increasing the angle at which a facet is oriented relative to the base plane 150, i.e., a bending spray angle β or splitting angle λ (FIGS. 4C and 4D). That is, the preferred embodiments, including the description of the techniques disclosed herein, allow the orifice disc to maintain the same spray targeting and enhance structural rigidity of the orifice disc 140 by reducing a ratio between the height "h" of the apex of the dimple with respect to a thickness "S" (distance between surfaces 20 and 40) of the orifice disc, i.e., a "h/S" ratio. And from a performance standpoint, a smaller sac volume can thereby be achieved due to the significant parameter of the smaller height of the apex of the dimple.

Prior to the formation of the first facet 143*a*, the orifice disc 140 includes first and second surfaces 20, 40 that extend substantially parallel to a base plane 150. The first and second surfaces 20 and 40 are spaced along a longitudinal axis 200. The longitudinal axis 200 extends orthogonally with respect to the base plane 150, as shown in FIG. 2. Preferably, the first and second surfaces 20, 40 are spaced apart over a distance of from 75 microns to 300 microns.

The preferred embodiments of the orifice disc 140 can be formed by a method as follows. The method includes forming a first orifice 148 penetrating the first and second surfaces 20, 40, respectively, and also includes forming a first planar surface or facet 143*a* on which the first orifice 148 is disposed thereon such that the first facet 143*a* extends generally parallel to a first plane 152 oblique to the base plane 150. The first orifice 148 is defined by a first wall 148*a* that couples the fist and second surfaces, 20 and 40, respectively, and the first orifice 148 extends along a first orifice axis 202 oblique with respect to the longitudinal axis 200. Although the orifice can be formed of a suitable cross-sectional area such as for example, square, rectangular, oval or circular, the preferred embodiments include generally circular orifices having a diameter about 300 microns, and more particularly, about 150 microns. The first orifice 148 can be formed by a suitable technique or a combination of such techniques, such as, for example, laser machining, reaming, punching, drilling, shaving, or coining. Preferably, the first orifice 148 can be formed by stamping and punch forming such that when a dimpling tool deforms the work piece 10, a plurality of planar surfaces oblique to a base plane 150 can be formed. One of the plurality of the planar surfaces can include first facet 143*a*.

Thereafter, a second facet 143*b* can be formed at the same time or within a short interval of time with the first facet 143*a*. The second facet 143*b* can be generally parallel to a second plane oblique 154 to the base plane 150 such that the orifices disposed on the second facet is oblique to the longitudinal axis 200. The second facet 143*b* can also be oblique with respect to the first facet 143*a*. Additional facets can also be formed for the orifice disc in a similar manner to provide for a dimple with more than two facets.

In order to quantify the advantages of the preferred embodiments with respect to metering orifice plate that utilizes straight or non-angled orifices prior to the formation of facets (i.e., a control case), comparisons were made with respect to preferred embodiments that utilize angled orifices prior to the formation of facets. The control case was a work piece that utilizes orifices extending perpendicular to the planar surfaces of the work piece, which is deformed to form a plurality of facets. The orifice disc of the control case was configured so that it provides a desired fuel spray-targeting pat under controlled conditions. The test cases, on the other hand, utilize the preferred embodiments at various configurations such that these various configurations permit fuel spray targeting similar to the desired fuel spray targeting under the controlled conditions. That is, even though the physical geometry of each of the test cases was different, the fuel spray targeting of each of the test cases was required to be generally similar to that of the control case. And as used herein, spray targeting is defined as one of a bending spray angle or a splitting spray angle relative to the longitudinal axis 200 of a standardized fluid flowing through the fuel injector of the control case and the preferred embodiments at controlled operating conditions, such as, for example, fuel temperature, fuel pressure, flow rate and coil actuation duration.

An orifice disc 14 using perpendicular orifices prior to dimpling, i.e., a "pre-dimpled" disc, for the control case is shown in FIG. 4A. The pre-dimpled disc 14 can have an outside diameter of about 6 millimeters and include four orifices $\mathbf{12}_I$, $\mathbf{12}_{II}$, $\mathbf{12}_{III}$, and $\mathbf{12}_{IV}$ located about the geometric center of the orifice disc and arrayed such that each of the centers of the orifices are located within respective quadrants I, II, III, and IV for this particular example. Specifically, two of the orifices, denoted here as orifice $\mathbf{12}_I$ and $\mathbf{12}_{IV}$, are symmetrical about centerline $X_0$-$X_0$. Each of orifices $\mathbf{12}_I$ and $\mathbf{12}_{IV}$ is located at, respectively, approximately 10 degrees from centerline Y-Y. Orifices $\mathbf{12}_{II}$ and $\mathbf{12}_{III}$ are also symmetrical about centerline $X_0$-$X_0$ and each is located at approximately 55 degrees from the centerline $Y_0$-$Y_0$. Each of the orifices $\mathbf{12}_I$, $\mathbf{12}_{II}$, $\mathbf{12}_{III}$, and $\mathbf{12}_{IV}$ extends generally perpendicular through disc 14 such that an axis of each of the orifices is generally parallel to the longitudinal axis A-A of the fuel injector prior to being dimpled, and therefore the angle of deviation (i.e., orifice angle $\alpha$) between the axis of each of the orifices $\mathbf{12}_I$, $\mathbf{12}_{II}$, $\mathbf{12}_{III}$, and $\mathbf{12}_{IV}$ with the longitudinal axis is about zero degrees.

The orifice disc 140 after dimpling, i.e., a "post-dimpled" orifice disc is shown for the control case in FIG. 4B, as viewed from outside of the fuel injector, as a multi-facetted dimple 140*a*. Preferably, the multi-faceted dimple 140*a* includes six generally planar facets that are oblique to a base plane 150 extending through the peripheral portion of the orifice disc 140. For comparative purposes, the multi-faceted dimple 140*a* is depicted with various dimensions that reference each of the orifices to various intersecting segments between the facets, which are used as referential datum for this comparison. In particular, a first tangent for orifice $\mathbf{12}_{IV}$ parallel to facet segment "F" with the distance between the tangent and the facet segment F being designated as $dT_{IVF}$; and a second tangent for orifice $\mathbf{12}_{IV}$ parallel to facet segment "G" with the distance between the tangent and the facet segment G being designated as $dT_{IVG}$. A first tangent for orifice $\mathbf{12}_{III}$ parallel to facet segment "H" with the distance between the tangent and the facet segment H being designated as $dt_{IIIH}$; a second tangent for orifice $\mathbf{12}_{III}$ parallel to facet segment "E" with the distance between the tangent and the facet segment E being designated as $dT_{IIIE}$; and a third tangent for orifice $\mathbf{12}_{III}$ parallel to facet segment "D" with the distance between the tangent and the facet segment D being designated as $dT_{IIID}$. Furthermore, the maximum height "h" of the apex of the dimple 143*a*, bending spray angles $\beta$, and splitting angle $\lambda$, shown here in FIGS. 4C and 4D, respectively, are also measured. As used herein, the bending spray angle $\beta$, as applied to a multifaceted dimple, denotes the angle of a dimpled surface with respect to the base plane 150 that tends to orient a flow of fuel through the metering orifices asymmetrically with respect to axis $Y_o$-$Y_o$ and towards two or more sectors. As also used herein, the splitting angle $\lambda$ denotes the angle of a dimpled surface with respect to the base plane 150 that tends to orient a flow of fuel through the metering orifices symmetrically with respect to axis $X_o$-$X_o$ (FIG. 4D). The magnitudes of the parameters defining the multi-faceted dimple 143*a* are collated in the row labeled as "CONTROL" in Table I below.

TABLE I

Data of Control Case, First, Second, and Third Preferred Embodiments

| I Configuration | II Angle $\alpha$ | III Sac Volume $(mm)^3$ | IV Height "h" of Apex of Facet "H" (mm) | VI h/S ratio | V Bending Angle $\beta$ (degrees) | VII Splitting Angle $\lambda$ (degrees) | VIII $dT_{IVF}$ (mm) | IX $dT_{IVG}$ (mm) | X $dT_{IIID}$ (mm) | XI $dT_{IIIE}$ (mm) | XII $dT_{IIIH}$ (mm) |
|---|---|---|---|---|---|---|---|---|---|---|---|
| CONTROL | 0* | 0.812 | 0.56 | 0.1 | 21* | 16* | 0.354 | 0.393 | 0.225 | 0.228 | 0.097 |
| DISC 1 | 6* | 0.726 | 0.491 | 0.09 | 17.7* | 12.8* | 0.228 | 0.284 | 0.341 | 0.268 | 0.093 |
| DISC 2 | 8* | 0.768 | 0.490 | 0.09 | 17.0* | 11.5* | 0.224 | 0.302 | 0.418 | 0.234 | 0.096 |
| DISC 3 | 10* | 0.698 | 0.467 | 0.08 | 16.4* | 10.2* | 0.237 | 0.252 | 0.400 | 0.235 | 0.089 |

Figure 5A:
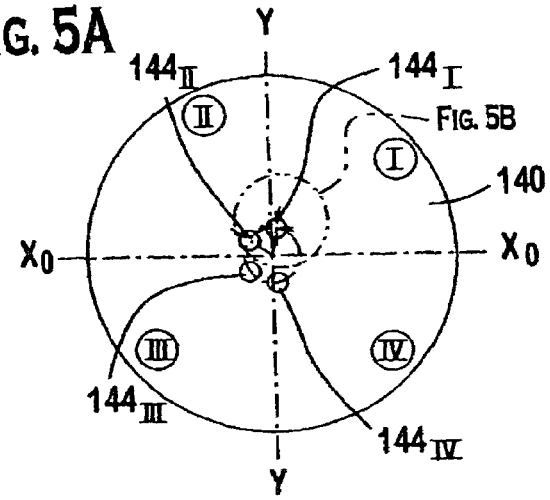
FIGS. 5A and 5B illustrate an orifice disc, prior to dimpling, that can be used for the preferred embodiments.
Figure 5B:
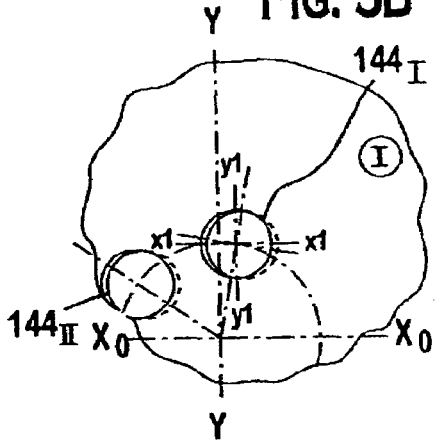

FIG. 5A illustrates a "pre-dimpled" orifice disc 140 that can be used for the preferred embodiments. Reference is made with the view of FIG. 5B, which shows two of the four orifices as angled orifices extending through the orifice disc at orifice angle α with respect to the longitudinal axis 200 (FIG. 2) of about six degrees (6°). The disc 140 is deformed to form a multi-faceted dimple 156, as shown in solid lines in FIG. 6.

FIG. 6 provides a pictorial comparison of a "post-dimpled" first preferred embodiment (facets depicted as solid lines) 156 with the multi-facetted dimple 140*a* of the control case (depicted as dashed lines). The preferred embodiment of FIG. 6 uses orifices, in the pre-dimpled orifice disc, with an orifice angle α of six degrees as measured to the perpendicular axis 200 or its complementary angle of eighty-four degrees (84°) as measured to the base plane 150. It should be noted that the particular configuration of the multi-faceted dimple 156 of FIG. 6 allows the orifice disc 140 to obtain approximately the same injector spray targeting as the control case. Further, it can be seen in the row labeled "Disc 1" of Table I that significant parameters defining the geometry of various facets of the first preferred embodiment as compared to the control case are much smaller in magnitude (as signified by bold notations for each of the parameters in Table I) for the same spray targeting as the control case. The decreases in these significant parameters are believed to be advantageous. The five significant parameters include: the height "h" of apex H; ratio of height "h" to the thickness "S" of the orifice disc; sac volume, bending spray angle β and splitting angle λ. For example, the sac volume is reduced by approximately 11%; the bending spray angle β by 16%; the splitting angle λ by approximately 20%; and the ratio of height h to thickness S by at least 10% thereby enhancing the rigidity of the orifice disc. And increases in parameters in columns X and XI relating to a distance between a tangent of an orifice relative to a facet line are believed to be advantageous because the orifices are now placed further away from the respective facet line. Because the orifices are placed further away from facet lines, they are therefore less susceptible to distortions due to machining or manufacturing operations.

Figure 7:
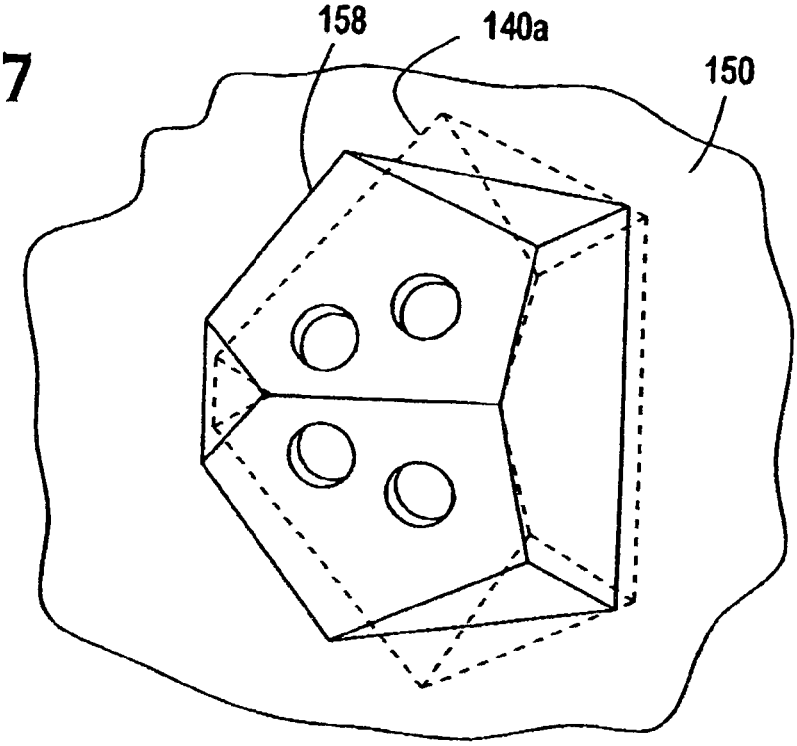
FIG. 7 illustrates a comparison between a configuration of a second preferred embodiment of an orifice disc relative to the control case that achieves the same exemplary spray results.

FIG. 7 illustrates a second preferred embodiment of a multi-facet dimple 158 (depicted as solid lines) in comparison with the dimple 140*a* of the control case (designated as dashed lines). The preferred embodiment of FIG. 7 uses orifices, in the pre-dimpled orifice disc, with an orifice angle α of eight degrees (8°) as measured to the axis 200 of the pre-dimpled orifice disc or its complementary angle of eighty-two degrees (82°) as measured to the base plane 150. Similar to the first preferred embodiment, it can be seen in the row labeled "Disc 2" that significant parameters defining the geometry of various facets of the second preferred embodiment as compared to the control case and the first preferred embodiment are much smaller in magnitude (as signified by bold notations) for the same spray targeting as the control case.

Figure 8:
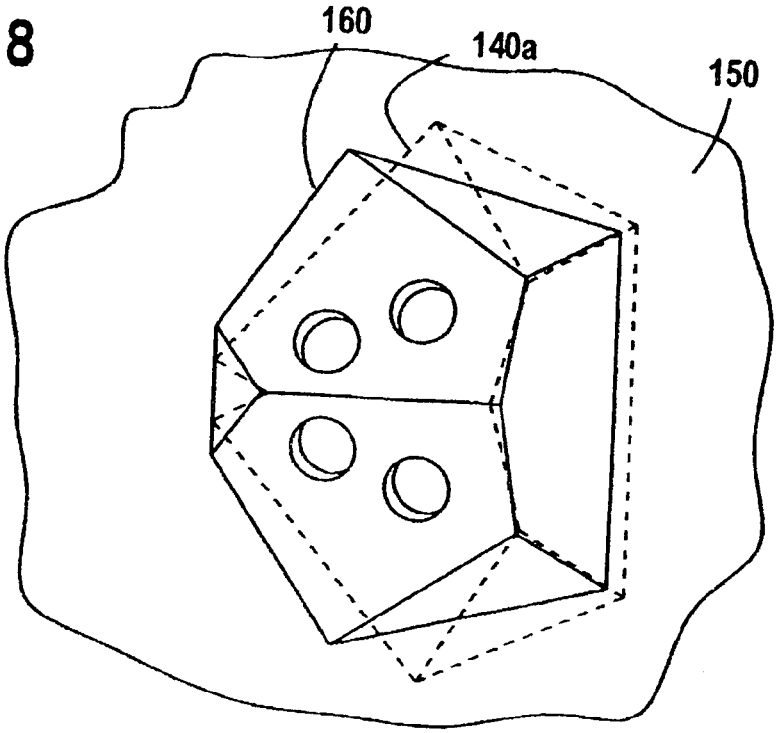
FIG. 8 illustrates a comparison between a configuration of a third preferred embodiment of an orifice disc relative to the control case that achieves the same exemplary spray results.

FIG. 8 illustrates a third preferred embodiment (depicted as solid lines) of a multi-facetted dimple 160 in comparison with the dimple 140*a* of the control case (designated as dashed lines). The preferred embodiment of FIG. 8 uses orifices, in the pre-dimpled orifice disc, with an orifice angle α of ten degrees as measured with respect to the longitudinal axis 200 or its complementary angle of eighty degrees (80°) as measured to the base plane 150. It should be noted that the particular configuration of the multi-faceted dimple 160 of FIG. 8 allows an orifice disc of FIG. 8 to obtain approximately the same spray targeting as the control case. Similar to the first and second preferred embodiments, it can be seen in the row labeled "Disc 3" that significant parameters defining the geometry of various facets of the third preferred embodiment as compared to the control case, the first and second preferred embodiments are much smaller in magnitude (as signified by bold notations) for the same spray targeting as the control case. Additionally, it should be noted that a trend can be seen in Table I in that the significant parameters should be decreased when the angle α of an orifice relative to a axis 200 is increased prior to dimpling.

The comparative analysis above is believed to illustrate the advantages of the present invention in allowing for at least a reduced sac volume, apex height "h", "h/S" ratio, bending spray angle β and splitting angle λ while maintaining the same spray targeting of a control case that uses perpendicularly-oriented orifices in the pre dimpled orifice disc. Furthermore, by comparisons with a control case, it can be seen that the preferred embodiments permit generally the same desired fuel spray targeting previously achievable with a control case yet with better fuel injector characteristics such as, for example, sac volume, lower material distortion or failure of the orifice disc during the manufacturing process. Moreover, it can be seen that the spray angle θ of each of the orifices is now a result of at least two angles (orifice angle α and at least one of the bending spray angle β and splitting angle λ) such that expanded ranges of bending and splitting angles can be manufactured without causing any reduction in structural integrity of the orifice disc 140 while also reducing the sac volume, the height of the apex and the amount of dimpling force or stress applied to the orifice disc that would otherwise not be achievable without utilization of the preferred embodiments.

FIGS. 9-11 illustrate the ability of the preferred embodiments to achieve a similar spray targeting of the control case but with smaller dimple geometries as compared to the dimple geometries of the control case. As noted earlier in the preferred embodiments (FIG. 1B), the first and second planar facets F1 and F2 intersect each other to define a line H extending at a bending spray angle β of less than 21 degrees with respect to the base plane 150 (FIG. 4C). Furthermore, each of the first and second planar facets is configured to extend at a splitting angle λ of less than 16 degrees with respect to the base plane 150 (FIG. 4D).

Upon actuation of the magnetic actuator 134 to move the closure member to the actuated position, fuel is permitted to flow through the orifice disc in order to achieve a desired spray pattern similar to the control case. In particular, as shown in FIG. 9, the fuel flow intersects a virtual plane 180 orthogonal to the longitudinal axis A-A at a distance "LT" of about 50-100 millimeters along the longitudinal axis A-A to define a flow pattern 182 similar to that of the control case. The flow pattern 182 has a first portion FA1 about a first arcuate sector of about 180 degrees being greater in area than a second portion FA2 on a contiguous second sector of about 180 degrees on the virtual plane 180. The flow pattern 182 can be defined by a plurality of radii $r_1$, $r_2$, $r_3$ . . . $r_n$ about the longitudinal axis such that, by virtue of the preferred embodiments, a fuel injector can flow fuel to a target at a generally similar flow pattern achieved by the control case. Preferably, the distance LT is about 50 to 100 millimeters along the longitudinal axis A-A.

The targeting of the fuel injector can also be performed by rotational adjustment of the orifice disc 140 relative to the longitudinal axis or by rotational adjustment of the housing relative to the orifice disk 140 so as to achieve a desired targeting configuration. A target can be placed on a virtual plane 180 disposed generally orthogonal to the longitudinal axis so that a suitable fluid spray from a fuel injector 100 can define a flow pattern with a plurality of different radii about the longitudinal axis. One of the radii (e.g., $r_1$, $r_2$, $r_3$ . . . $r_n$) defining the flow pattern includes a maximum radius $r_{max}$ that, when rotated about the longitudinal axis A-A, defines an imaginary circular area 186. The circular area 186 is larger than a portion covered by the flow pattern of fuel (e.g., fuel flow pattern such as FA1 or FA2). That is, the imaginary circular area 186 has uncovered portion 184 which is not impinged by fuel flow on the virtual plane spaced at the distance LT. Where the portion covered by the flow pattern is not a desired target portion, the flow pattern 182 can be oriented about the longitudinal axis A-A so as to adjust a targeting of the flow pattern 182 towards a different portion of the imaginary circular area 186 such as the non-covered portions 184. That is, where targeting of the flow pattern requires orientation of the metering orifices about the longitudinal axis, either the orifice disc or the fuel injector can be oriented with respect to each other. Also, the body 128 containing orifice disc can be rotated relative to the housing or a modular power group subassembly. Alternatively, the orifice disc 140 can be angularly fixed relative to a reference point on the body of the fuel injector. Upon installation into a fuel rail or manifold, the housing of the fuel injector can be rotated about the longitudinal axis to another reference point on the fuel rail or fuel injector cup (not shown) and then locked into position, thereby providing a desired targeting of the fuel flow pattern for the particular engine configuration. Subsequently, fuel injectors for this particular engine configuration can be orientated at the desired targeting configuration by one or a combination of the preceding procedures. And by re-orientating the flow pattern as needed for a specific engine configuration, as described above, a desired fuel spray targeting towards a specific portion of area with the imaginary circular area 186 defined by the maximum radius $r_{max}$ can be achieved.

While the present invention has been disclosed with reference to certain preferred embodiments, numerous modifications, alterations, and changes to the described embodiments are possible without departing from the sphere and scope of the present invention, as defined in the appended claims. Accordingly, it is intended that the present invention not be limited to the described embodiments, but that it have the fill scope defined by the language of the following claims, and equivalents thereof.

What I claim is:

1. A fuel injector for metering and spray targeting fuel, the fuel injector comprising:

a seat including a passage extending along a longitudinal axis;

a closure member disposed in the passageway and contiguous to the sealing surface so as to generally preclude fuel flow through the seat aperture in one position, the closure member being coupled to a magnetic actuator that, when energized, positions the closure member away from the sealing surface of the seat so as to allow fuel flow through the passageway and past the closure member; and an orifice disc including:

first and second surfaces, the first surface confronting the seat, and the second surface facing opposite the first surface;

a peripheral portion extending parallel to a base plane, and the base plane being generally orthogonal with respect to the longitudinal axis;

a central portion being bounded by the peripheral portion and including first and second planar five-sided irregular polygon facets extending from the peripheral portion, the first and second planar five-sided irregular polygon facets intersecting each other to define a segment extending at a first angle of less than 21 degrees with respect to the base plane, each of the first and second planar five-sided irregular polygon facets extending at a second angle of less than 16 degrees with respect to the base plane, the first and second planar five-sided irregular polygon facets being bounded by a first planar triangular facet and a third planar facet five-sided irregular polygon extending from the peripheral portion, the central portion further including a second planar triangular facet being bounded by the first planar five-sided irregular polygon facet and the third planar five-sided irregular polygon facet, and a third planar triangular facet being bounded by the second planar five-sided irregular polygon facet and the third planar five-sided irregular polygon facet; and at least one orifice penetrating each of the first and second planar five-sided irregular polygon facets, each of the first and second planar five-sided irregular polygon facets having respective first and second facet surfaces where the at least one orifice extends along a central orifice axis, and the central orifice axis is oblique with respect to a respective planar facet surface by a combination of a first relationship of the respective planar facet surface with respect to the base plane and a second relationship of the central orifice axis with respect to the respective planar facet surface so that when the magnetic actuator moves the closure member to the actuated position, a flow of the fuel from the orifice disc intersects a virtual plane orthogonal to the longitudinal axis to define a flow pattern having a first portion about a first arcuate sector of about 180 degrees being greater in area than a second portion on a contiguous second sector of about 180 degrees on the virtual plane.

2. The fuel injector of claim 1, wherein the virtual plane is located at least 50 to 100 millimeters from the second surface of the orifice disc.

3. The fuel injector of claim 2, wherein the flow pattern has a plurality of different radii about the longitudinal axis.

4. The fuel injector of claim 3, wherein the first surface is generally parallel to the second surface.

5. The fuel injector of claim 4, wherein the first and second planar five-sided irregular polygon facets extend away from the seat and oblique to the longitudinal axis.

* * * * *